US007657205B2

(12) United States Patent
Kang

(10) Patent No.: US 7,657,205 B2
(45) Date of Patent: Feb. 2, 2010

(54) MULTI-FUNCTION PERIPHERAL INCLUDING FINISHER

(75) Inventor: Nae-wan Kang, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 539 days.

(21) Appl. No.: 11/523,700

(22) Filed: Sep. 20, 2006

(65) Prior Publication Data

US 2007/0085257 A1 Apr. 19, 2007

(30) Foreign Application Priority Data

Oct. 13, 2005 (KR) ..... 10-2005-0096502

(51) Int. Cl.
*G03G 15/00* (2006.01)

(52) U.S. Cl. ..... 399/110; 399/407

(58) Field of Classification Search ..... 399/107, 399/110, 405, 407, 408, 409, 410
See application file for complete search history.

(56) References Cited

U.S. PATENT DOCUMENTS 5,080,348 A * 1/1992 Pendell et al. ..... 271/289
6,134,418 A * 10/2000 Kato et al. ..... 399/405
6,233,427 B1 * 5/2001 Hirota et al. ..... 399/407
6,647,243 B2 * 11/2003 Sato et al. ..... 399/407
6,671,491 B1 * 12/2003 Yamanaka et al. ..... 399/407
6,671,492 B2 * 12/2003 Mimura et al. ..... 399/407
6,898,395 B2 * 5/2005 Mui et al. ..... 399/107
7,136,606 B2 * 11/2006 Rose et al. ..... 399/107
7,288,059 B2 * 10/2007 Ikeda et al. ..... 493/444
7,431,287 B2 * 10/2008 Hayashi et al. ..... 271/162
2004/0114686 A1 6/2004 Sugiyama et al.
2004/0183246 A1 9/2004 Jung et al.

FOREIGN PATENT DOCUMENTS

JP 05294538 A * 11/1993
JP 2002-3062 1/2002
KR 2003-82733 10/2003
WO WO 00/71362 11/2000

* cited by examiner

*Primary Examiner*—Robert Beatty
(74) *Attorney, Agent, or Firm*—Stein McEwen, LLP

(57) ABSTRACT

A multi-function peripheral including: a printing portion; a scanning portion reading an image from a document; a discharge portion disposed between the printing portion and the scanning portion, and loading sheets of print media on which images are formed; and a finisher installed on the discharge portion to post-process the print media, on which the image is formed. The finisher includes: a plurality of fixing units including a first fixing portion disposed on a lower portion of the finisher in order to prevent the finisher from moving upward and a second fixing portion that can rotate so as to prevent the finisher from moving in an attaching direction on the discharge portion.

28 Claims, 8 Drawing Sheets

MULTI-FUNCTION PERIPHERAL INCLUDING FINISHER

CROSS-REFERENCE TO RELATED APPLICATION

This application claims the benefit of Korean Patent Application No. 2005-96502, filed on Oct. 13, 2005, in the Korean Intellectual Property Office, the disclosure of which is incorporated herein by reference.

BACKGROUND OF THE INVENTION

1. Field of the Invention

Aspects of the present invention relate to a multi-function peripheral, and more particularly, to a multi-function peripheral including a finisher performing a post-process such as classification of a discharging document after forming an image thereon.

2. Description of the Related Art

In general, image forming apparatuses, such as copying machines, printers, and multi-function peripherals, can include a finisher performing aligning, classifying, stapling, or other post-processes of documents on which images are formed. The finisher is installed on a portion of a main body where the documents are discharged. However, in order to install the finisher on the discharging portion of the main body, a structure of the discharging portion of the main body may be significantly changed, and, if necessary, an upper structure of a scanning portion may be disassembled, or the outer appearance of a conventional discharge tray may be altered. As a result, the process of installing the finisher may be too complex for an ordinary user, and thus, may require a technician.

In particular, in a front input side output (FISO) type multi-function peripheral, when a built-in type finisher is installed, an outer appearance substantially changes and many processes are required to connect the finisher to the main body. Therefore, an external finisher is mainly used.

When the built-in finisher is installed in the multi-function peripheral, many elements connecting the main body and the finisher are complex. Thus, the user may not be able to install the finisher easily.

SUMMARY OF THE INVENTION

Aspects of the present invention provide a multi-function peripheral including a finisher that can be easily and firmly installed on the multi-function peripheral by a user.

According to an aspect of the present invention, there is provided a multi-function peripheral including: a printing portion; a scanning portion reading an image from a document; a discharge portion disposed between the printing portion and the scanning portion, and loading sheets of print media on which images are formed; and a finisher installed on the discharge portion to post-process the print media, on which the image is formed, wherein the finisher includes: a plurality of fixing units including a first fixing portion disposed on a lower portion of the finisher in order to prevent the finisher from moving upward and a second fixing portion that rotates so as to prevent the finisher from moving in an attaching direction on the discharge portion.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
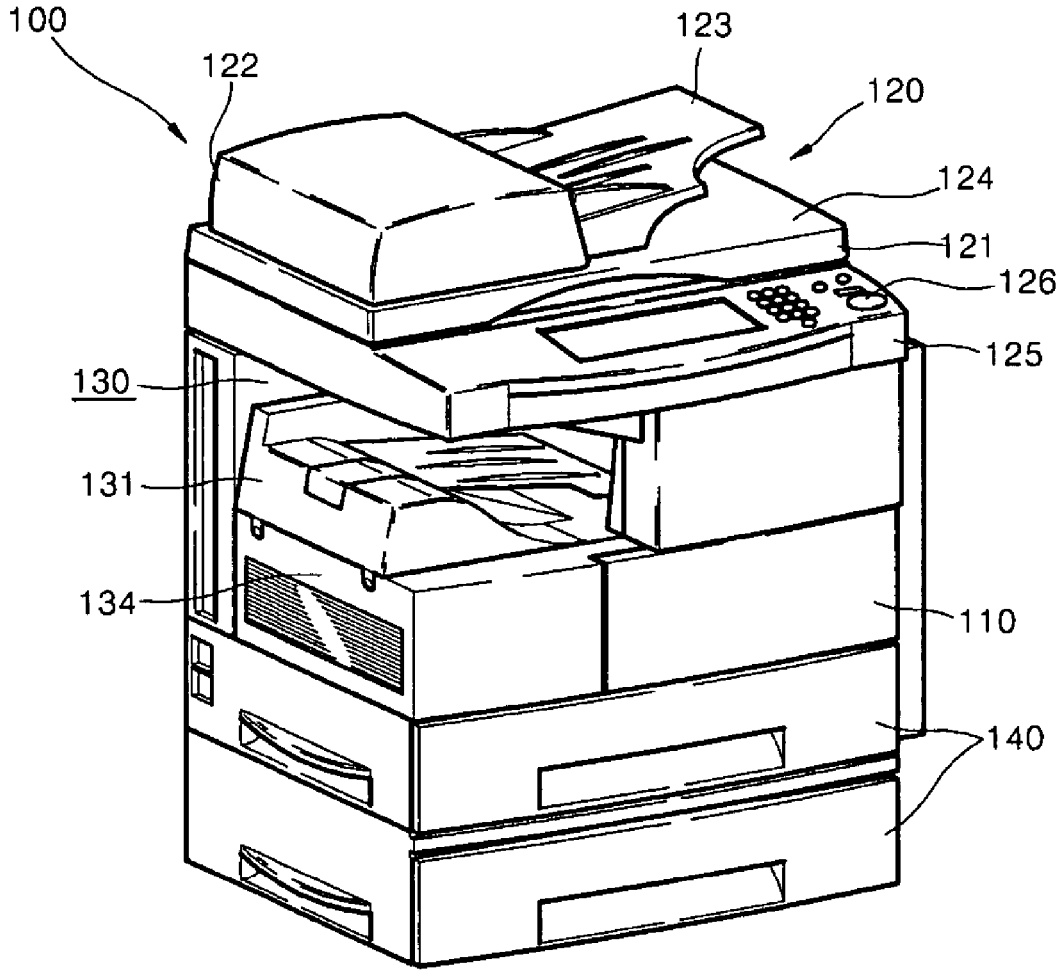
FIG. 1 is a perspective view of a multi-function peripheral including a discharge tray.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
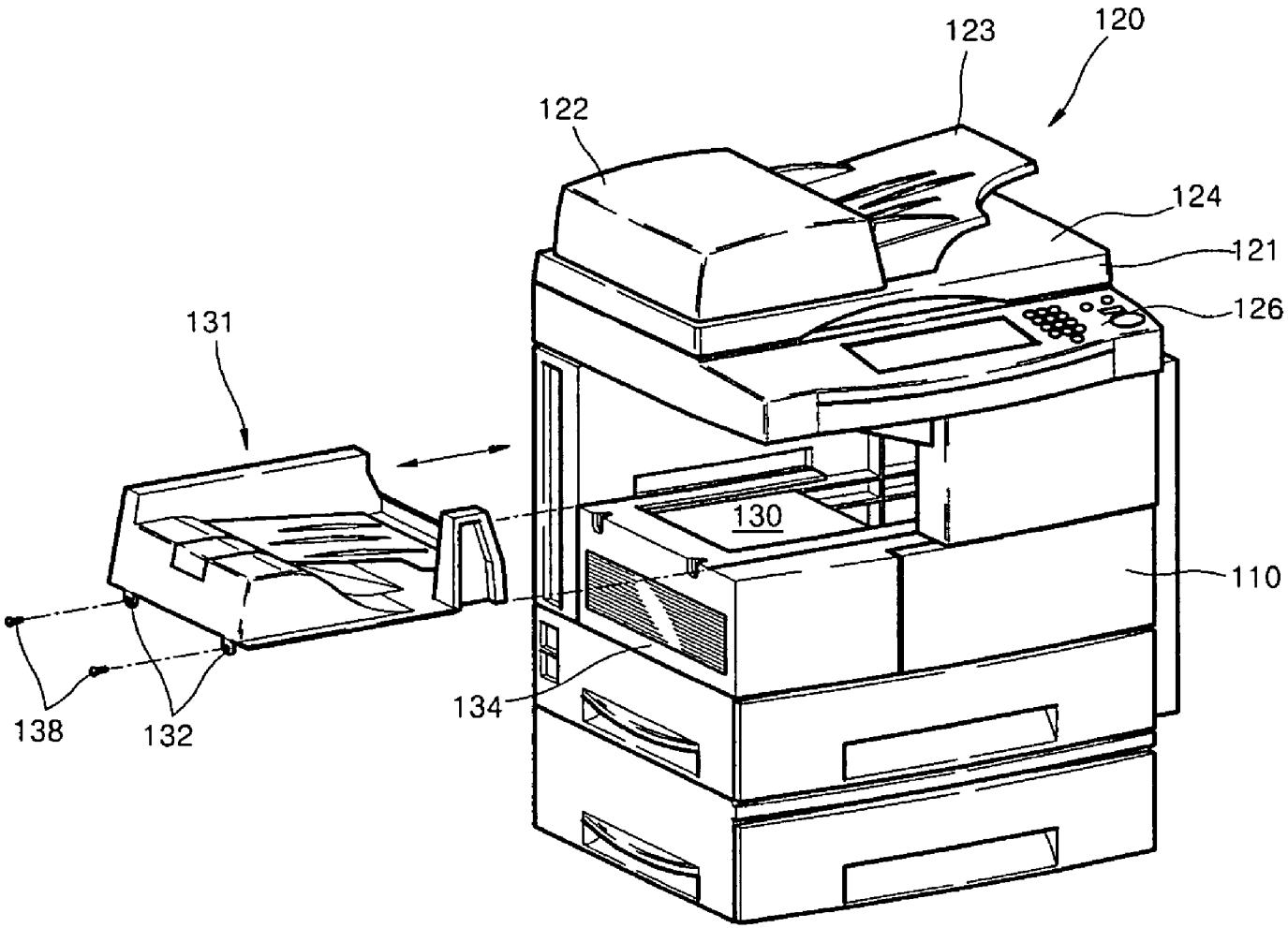
FIG. 2 is a perspective view of the multi-function peripheral of FIG. 1, from which the discharge tray is separated.
Figure 3:
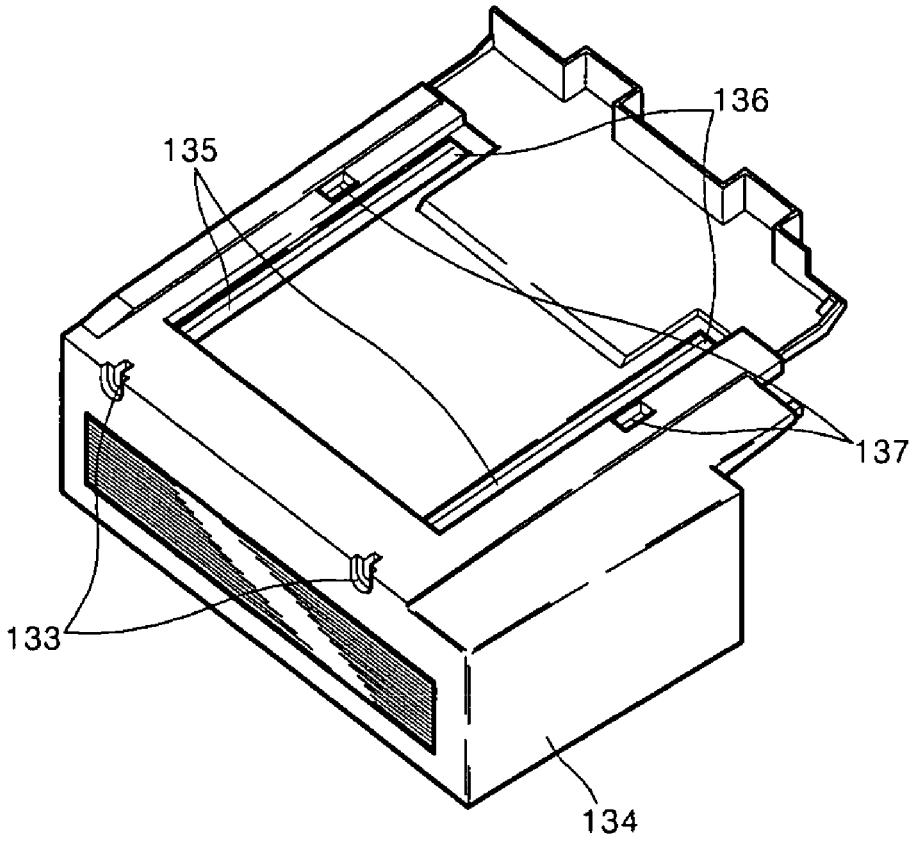
FIG. 3 is a perspective view of a discharge portion bottom cover separated from the multi-function peripheral of FIG. 1.

Referring to FIGS. 1 through 3, a multi-function peripheral 100 includes a printing portion 110 to form images on print media; a scanning portion 120, which is disposed on the printing portion 110 to read an image from a document and to input image information corresponding to the real image; and a discharge portion 130, which is disposed between the printing portion 110 and the scanning portion 120 to receive sheets of print media on which images are formed by the printing portion 110. It is understood that the multi-function peripheral 100 can have other functions and can have fewer functions than all of the shown functions in other aspects.

The printing portion 110 includes a printing engine (not shown), which forms images on the sheets of print media picked up from a print media cassette 140 and passed through the printing engine (not shown).

The multi-function peripheral of FIGS. 1 through 3 is a front input side output (FISO) type multi-function peripheral, but the invention is not limited thereto. The print media loaded in the print media cassette 140 that is opened frontward is picked up one by one to form an image thereon. The picked up paper is then discharged to the print media discharge portion 130 formed on a side portion of the machine.

The scanning portion 120 includes a lower frame 125 and a cover 121. The lower frame 125 is disposed above the printing portion 110 and the discharge portion 130, and includes a controller 126. In addition, the cover 121 opens/closes while rotating with respect to the lower frame 125, and includes a document loading board 123, an automatic document feeding unit 122, and a document discharge tray 124, on which the discharging documents are loaded.

A glass plate (not shown) is placed on the lower frame 125, and an image sensor (not shown) that scans the light onto the document and reads the image by linearly reciprocating may be disposed under the glass plate. Therefore, the document loaded on the document loading board 123 passes on the glass plate by the automatic document feeding unit 122, and the image sensor reads the image of the document and stores the image, faxes the image, and/or transmits the image to a connected computer. The document is loaded on the document discharge tray 124.

The discharge portion 130 is a space where the print media, on which the image is formed, is discharged. While not required in all aspects, the shown discharge portion 130 includes a discharge tray 131 loading the discharged print media. The discharge tray 131 is fixed on a discharge portion bottom cover 134 forming the lower portion of the discharge portion 130. A plurality of fixing protrusions 132 is formed on a side of the discharge tray 131, and the plurality of fixing protrusions 132 is coupled to fixing recesses 133 formed on the discharge portion bottom cover 134. The discharge tray 131 is fixed on the discharge portion bottom cover 134 by inserting coupling units 138 into the plurality of fixing protrusions 132 and the fixing recesses 133. The coupling units 138 may be screws or wedges, and can be controlled easily by a user by, for example, using a coin according to aspects of the invention. However, it is understood that more or fewer coupling units 138 can be used, and that other mechanisms can be used to maintain a position of the discharge tray 131.

The discharge portion bottom cover 134 includes guide rails 135 placed in parallel to each other in a direction in which the print media is discharged. A plurality of first recesses 136 is formed on end portions of the guide rails 135. A plurality of second recesses 137 is formed on the upper portion of the discharge portion bottom cover 134. The plurality of first and second recesses 136 and 137 also fix a finisher 150 (FIGS. 4 to 6) that is mounted on the discharge portion 130 according to an aspect of the invention.

Figure 4:
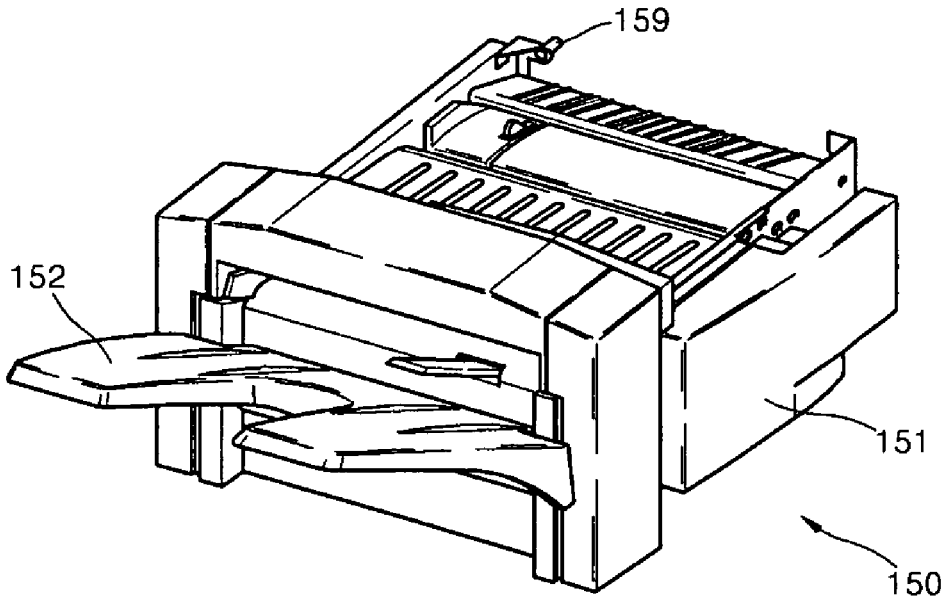
FIGS. 4 and 5 are perspective view of a finisher according to an embodiment of the present invention.
Figure 5:
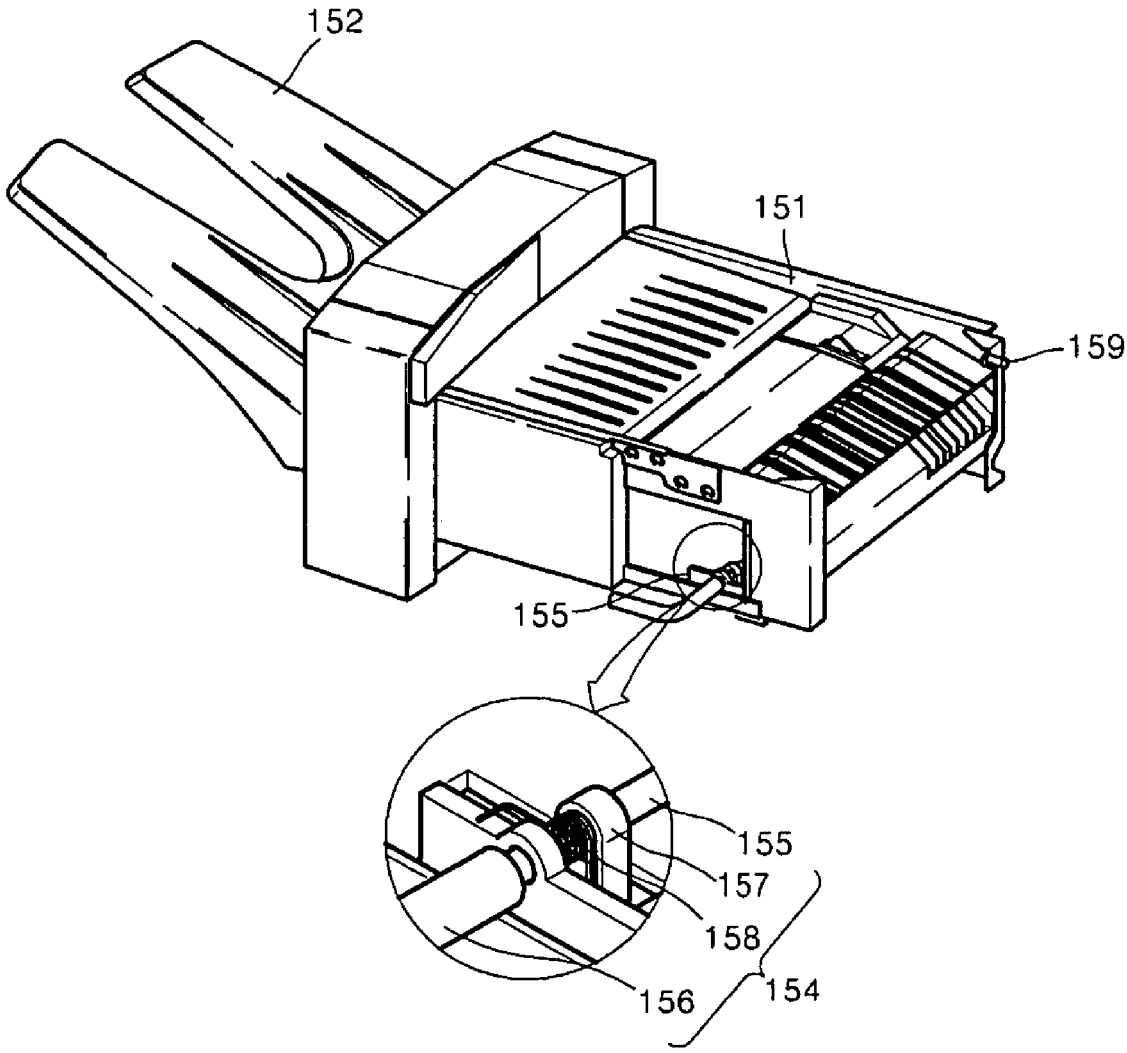
Figure 6:
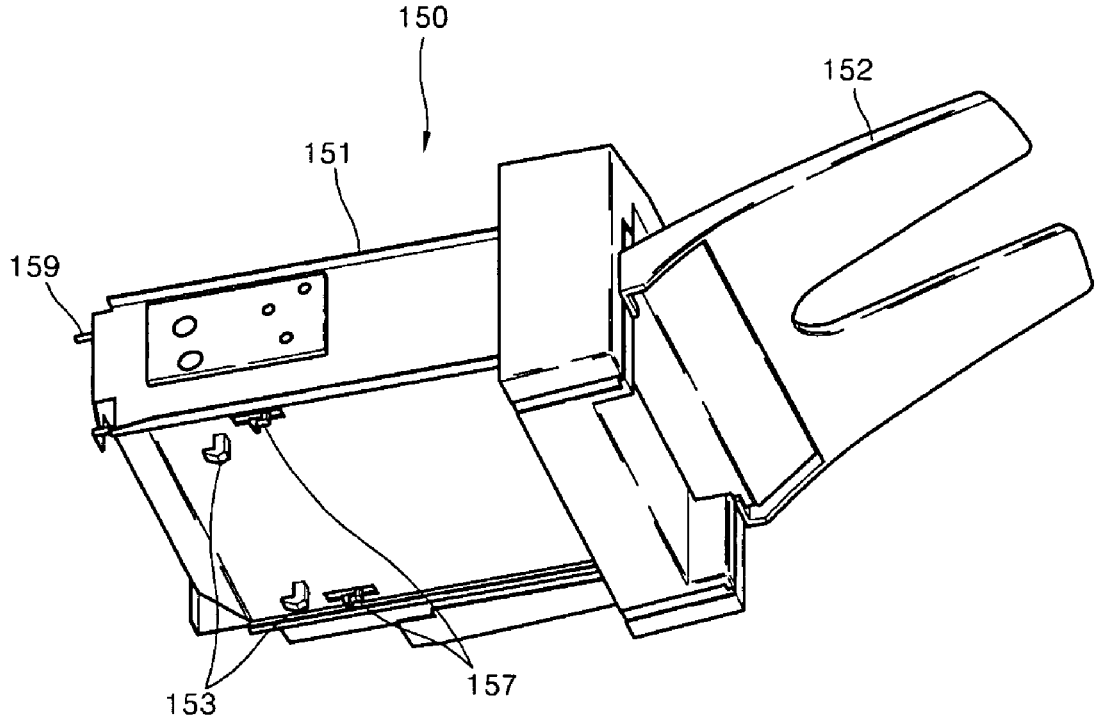
FIG. 6 is a rear view of the finisher of FIGS. 4 and 5.

Referring to FIGS. 4 through 6, the finisher 150, according to an embodiment of the present invention, includes a print media processing portion 151 performing a post-process, such as stapling of the print media discharged from the printing portion 110, and a stack tray 152 loading the print media to pass through the print media processing portion 151. The stack tray 152 may be provided to move in an up-and-down direction.

The finisher 150 includes a fixing unit having a plurality of first fixing portions 153 and a plurality of second fixing portions 154 on a lower portion thereof. The plurality of first fixing portions 153 is coupled to the plurality of first recesses 136 of the discharge portion bottom cover 134 to prevent the finisher 150 from moving upward. The plurality of first fixing portions 153 protrudes from a lower surface of the finisher 150, and is generally formed as hooks to prevent the finisher 150 from moving upward from the plurality of first recesses 136.

When the finisher 150 is mounted on the discharge portion 130, the plurality of first fixing portions 153 slides along the guide rails 135 on the discharge portion bottom cover 134 and is coupled to the plurality of first recesses 136 that is formed on the end portions of the guide rails 135. Referring to FIG. 5 and FIG. 6, each second fixing portion of the plurality of second fixing portions 154 includes a rotary shaft 155, to which a lever 156 is mounted on a side thereof, and a plurality of stepping portions 157 provided on the rotary shaft 155, each stepping portion having a hook shape and separated from an other by a predetermined distance and.

When the finisher 150 is installed on the discharge portion 130, the plurality of stepping portions 157 is inserted and coupled to the plurality of second recesses 137. Thus, the finisher 150 does not move in the direction in which the print media is discharged and does not otherwise move from the discharge portion 130.

A spring 158 of the rotary shaft 155 applies an elastic force in the direction of coupling the plurality of stepping portions 157 to the second recess 137. The lever 156 is exposed on the side surface of the finisher 150, and thus, the user can handle the lever 156 easily. However, it is understood that other mechanisms can be used to fix the finisher 150 in place, and the other mechanisms can be used to apply a biasing force to couple the plurality of stepping portions 157 to the second recess 137.

Figure 10:
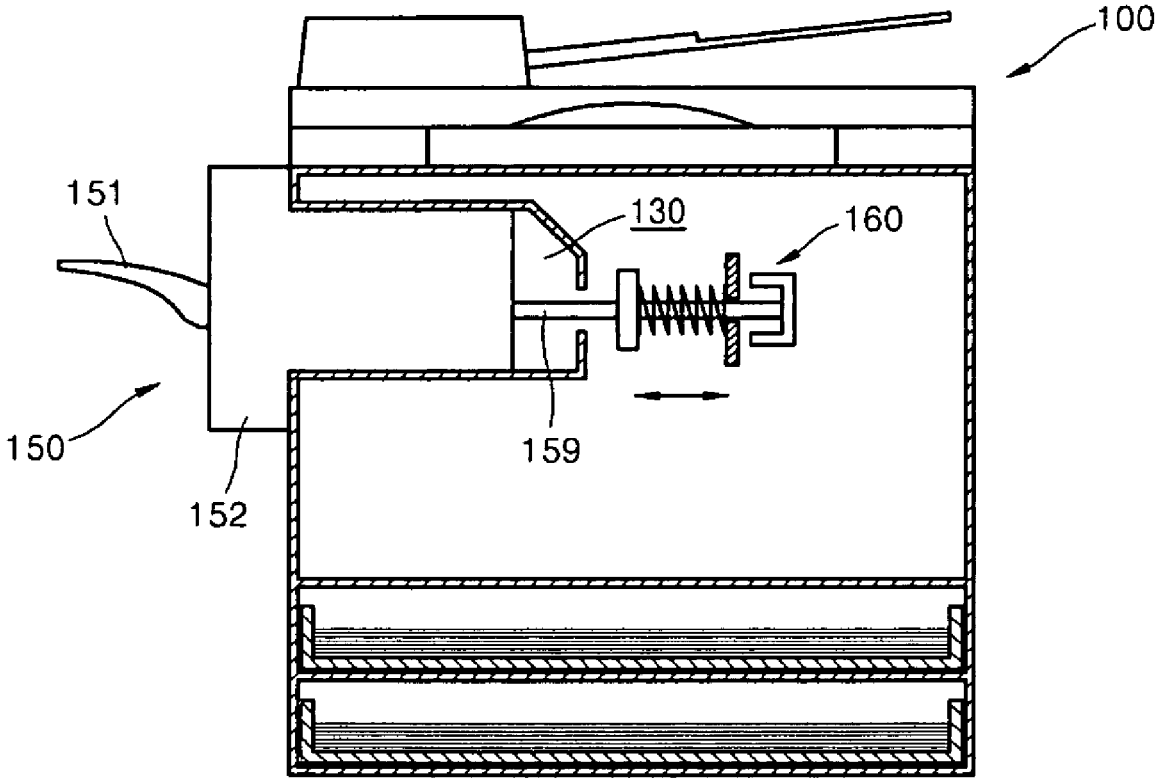
FIG. 10 is a side cross-sectional view illustrating a sensing unit of the finisher operating a sensor.

The finisher 150 includes a sensing portion 159 protruding from the print media processing portion 151. Referring to FIG. 10, when the finisher 150 is installed on the discharge portion 130, the sensing portion 159 contacts a sensor 160, provided on the printing portion 110, to operate the sensor 160. Thus, the sensor 160 can sense the status of whether the finisher 150 is installed on the discharge portion 130. In the shown embodiment, the sensor 160 is an on/off type sensor; however, the present invention is not limited thereto, and the sensor 160 can be of various types in order to sense whether the finisher 150 is installed. Further, the sensor 160 can be omitted in other aspects, such as where the attachment of the finisher is manually indicated.

Operations of attaching/detaching the finisher onto/from the discharge portion will be described with reference to accompanying drawings. Referring to FIGS. 3, 5, 6, and 7, when the finisher 150 is installed on the discharge portion 130, the plurality of first fixing portions 153 is guided and slides along the guide rails 135. The plurality of stepping portions 157 of the plurality of second fixing portions 154 contacts the upper surface of the discharge portion bottom cover 134 and rotates upward.

Figure 8:
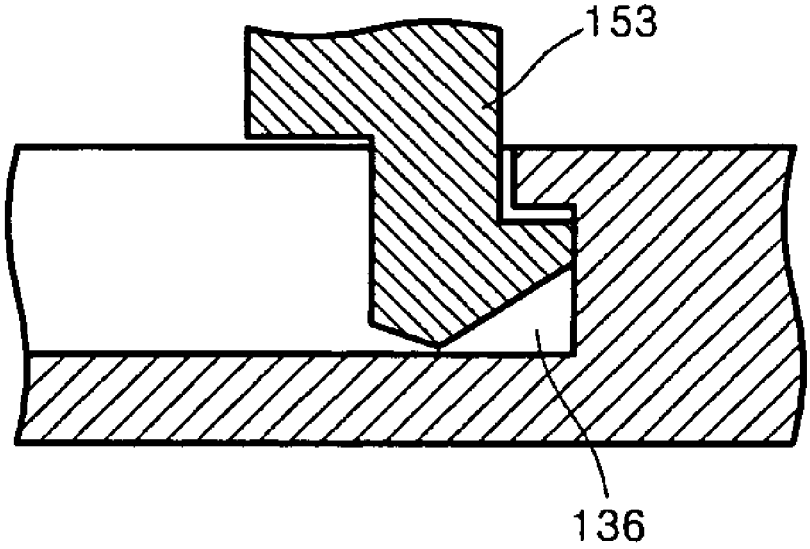
FIG. 8 is a side cross-sectional view of a first fixing unit of the finisher of FIGS. 4 and 5 coupled to a first recess.
Figure 9:
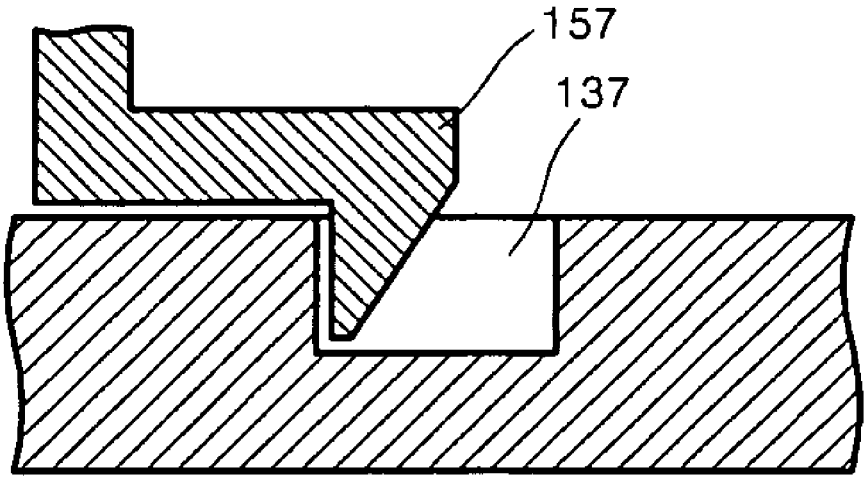
FIG. 9 is a side cross-sectional view of a second fixing unit of the finisher of FIGS. 4 and 5 coupled to a second recess.

When the plurality of first fixing portions 153 slides along the guide rails 135, the plurality of second fixing portions 154 slides while contacting the discharge portion bottom cover 134. The plurality of first fixing portions 153 is inserted into the plurality of first recesses 136, as shown in FIG. 8, and the plurality of stepping portions 157 of the plurality of second fixing portions 154 is inserted into the plurality of second recesses 137 as shown in FIG. 9. Therefore, the finisher 150 is installed on the discharge portion 130. Since the sensing portion 159 contacts the sensor 160, the sensor 160 senses that the finisher 150 is installed on the discharge portion 130.

The plurality of first fixing portions 153 inserted in the plurality of first recesses 136 prevents the finisher 150 from moving upward, and the plurality of stepping portions 157 of the plurality of second fixing portions 154 inserted in the plurality of second recesses 137 prevents the finisher 150 from moving in the direction in which the print media is discharged.

Figure 7:
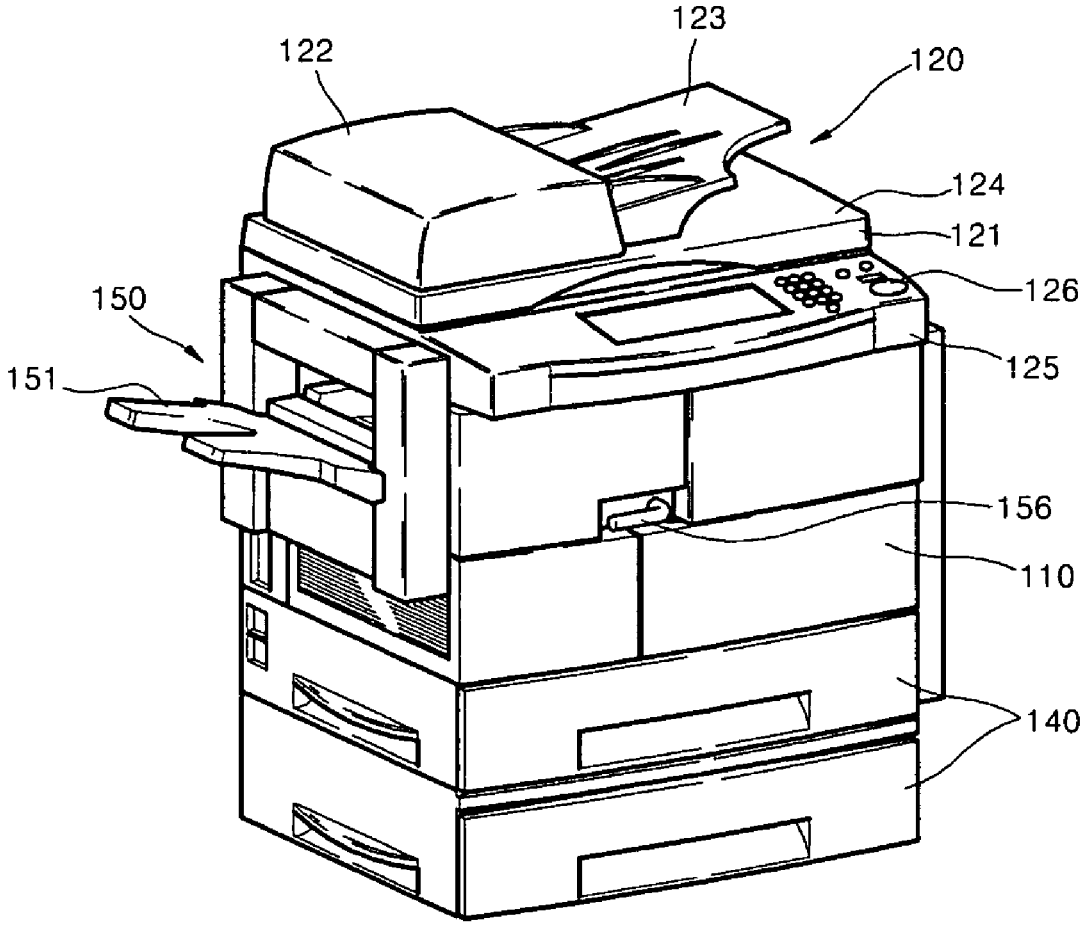
FIG. 7 is a perspective view of a multi-function peripheral including the finisher according to an embodiment of the present invention.

In order to separate the finisher 150 from the discharge portion 130, the user rotates the lever 156 that is exposed, as shown in FIG. 7, in the direction of overcoming the elastic force of the spring 158. Therefore, the plurality of stepping portions 157 of the plurality of second fixing portions 154 is separated from the plurality of second recesses 137, and the finisher 150 slides in the opposite direction of installation to be separated.

As described above, according to the multi-function peripheral including the finisher of the present invention, the user can easily attach/detach the finisher to/from the peripheral, and an installation space of the finisher can be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A multi-function peripheral comprising:

a printing portion to impart an image on print media;

a scanning portion to read an image from a document;

a discharge portion disposed between the printing portion and the scanning portion, which loads sheets of the print media, on which the images are formed by the printing unit; and a finisher installed on the discharge portion to post-process the print media, on which the image is formed, wherein the finisher comprises:

a plurality of fixing units comprising one or more first fixing portions, disposed on a lower portion of the finisher, in order to prevent the finisher from moving upward, and one or more second fixing portions, disposed on the lower portion of the finisher, that rotates so as to prevent the finisher from moving in an attaching direction on the discharge portion.

2. The multi-function peripheral as claimed in claim 1, wherein the first fixing portions protrude from the lower portion of the finisher, the discharge portion comprises one or more first recesses, to which the first fixing portions can be coupled, and the first fixing portions are coupled to the first recesses when the finisher is installed on the discharge portion.

3. The multi-function peripheral as claimed in claim 2, wherein the discharge portion comprises guide rails guiding the first fixing portions, and the first recesses are provided on end portions of the guide rails.

4. The multi-function peripheral as claimed in claim 1, wherein:

the second fixing portions comprise a rotary shaft comprising a lever and one or more stepping portions protruding from the rotary shaft and coupled to second recesses provided on the discharge portion, the rotary shaft is supported by an elastic force of a spring in a direction of coupling the stepping portions to the second recesses, and the stepping portions are separated from the second recesses by rotating the rotary shaft using the lever.

5. The multi-function peripheral as claimed in claim 4, wherein the lever is disposed on a side of the finisher and exposed to an outside of the finisher when the finisher is installed on the discharge portion so that a user may easily operate the lever.

6. The multi-function peripheral as claimed in claim 4, wherein the stepping portions are hook-shaped and the stepping portions are separated from each other by a predetermined distance.

7. The multi-function peripheral as claimed in claim 1, wherein the finisher further comprises a sensing portion that protrudes from the finisher to contact a sensor of the printing portion when the finisher is installed on the discharge portion and operates the sensor of the printing portion.

8. The multi-function peripheral as claimed in claim 1, wherein the finisher further comprises:

a print media processing portion to perform the post-process, and a stack tray to load the print media to pass through the print media processing portion.

9. The multi-function peripheral as claimed in claim 8, wherein the post-processing portion includes a staple unit that staples the print media.

10. A multi-function peripheral comprising:

a printing portion to impart an image on print media;

a discharge portion loading sheets of the print media, on which the images are formed by the printing unit; and a finisher detachably installed on the discharge portion to post-process the print media, on which the image is formed, and which comprises one or more fixing units comprising one or more fixing portions, disposed on the lower portion of the finisher, to prevent the finisher from detaching from the discharge portion.

wherein the one or more fixing portions protrude from a lower portion of the finisher and are respectively coupled to one or more corresponding recesses provided on the discharge portion when the finisher is installed on the discharge portion.

11. The multi-function peripheral as claimed in claim 10, wherein:

the one or more fixing portions comprise a rotary shaft comprising a lever and one or more stepping portions protruding from the rotary shaft and coupled to the one or more corresponding recesses provided on the discharge portion, the rotary shaft is supported by an elastic force of a spring in a direction of coupling the stepping portions to the recesses, and the stepping portions are separated from the one or more corresponding recesses by rotating the rotary shaft using the lever.

12. The multi-function peripheral as claimed in claim 11, wherein the lever is disposed on a side of the finisher and exposed to an outside of the finisher when the finisher is installed on the discharge portion so that a user may easily operate the lever.

13. The multi-function peripheral as claimed in claim 11, wherein the stepping portions are hook-shaped and the stepping portions are separated from each other by a predetermined distance.

14. The multi-function peripheral as claimed in claim 10, wherein the one or more fixing units further comprises one or more other fixing portions, disposed on the lower portion of the finisher, in order to prevent the finisher from moving upward.

15. The multi-function peripheral as claimed in claim 14, wherein the other fixing portions protrude from the lower portion of the finisher, the discharge portion comprises one or more other recesses, to which the other fixing portions are coupled, and the other fixing portions are coupled to the other recesses when the finisher is installed on the discharge portion.

16. The multi-function peripheral as claimed in claim 15, wherein the discharge portion comprises guide rails guiding the other fixing portions, and the other recesses are provided on end portions of the guide rails.

17. A multi-function peripheral comprising:

a printing portion to impart an image on print media;

a discharge portion loading sheets of the print media, on which the images are formed by the printing unit; and a finisher detachably installed on the discharge portion to post-process the print media, on which the image is formed, and which comprises one or more fixing units comprising one or more fixing portions, disposed on the lower portion of the finisher, to prevent the finisher from detaching from the discharge portion, wherein the finisher further comprises a sensing portion that operates a sensor of the printing portion, and the sensing portion protrudes from the finisher to contact the sensor of the printing portion when the finisher is installed on the discharge portion.

18. The multi-function peripheral as claimed in claim 10, wherein the finisher further comprises:

a print media processing portion to perform a post-process, and a stack tray to load the print media to pass through the print media processing portion.

19. The multi-function peripheral as claimed in claim 10, wherein the finisher includes a fastening unit that performs the post-process by connecting the print media.

20. The multi-function peripheral as claimed in claim 10, further comprising a scanning portion to read an image from a document.

21. A finisher to post-process print media and connect to a multi-function peripheral comprising a printing portion and a discharge portion having an attaching direction, the finisher comprising:

a post processing portion which receives printed media from the printing media via the discharge portion and performs an additional process on the received media; and one or more fixing portions which detachably connect to the discharge portion and, when attached to the discharge portion, prevent the finisher from moving in the attaching direction, wherein one or more of the fixing portions protrude from a lower portion of the finisher and are coupled to one or more recesses provided on the discharge portion when the finisher is installed on the discharge portion.

22. The finisher as claimed in claim 21, wherein the finisher further comprises a stack tray to load the print media to pass through the print media processing portion.

23. The finisher as claimed in claim 21, wherein the post-processing includes a fastener which fastens the print media.

24. A finisher to post-process print media and connect to a multi-function peripheral comprising a printing portion and a discharge portion having an attaching direction, the finisher comprising:

a post processing portion which receives printed media from the printing media via the discharge portion and performs an additional process on the received media; and one or more fixing portions which detachably connect to the discharge portion and, when attached to the discharge portion, prevent the finisher from moving in the attaching direction, wherein:

one of the fixing portions comprise a rotary shaft comprising a lever and one or more stepping portions protruding from the rotary shaft and coupled to a recess provided on the discharge portion, the rotary shaft is supported by an elastic force biased in a direction of coupling the stepping portions to the recess, and the stepping portions are separated from the recess by rotating the rotary shaft using the lever.

25. The finisher as claimed in claim 24, wherein the lever is disposed on a side of the finisher and exposed to an outside of the finisher when the finisher is installed on the discharge portion so that a user may easily operate the lever.

26. The finisher as claimed in claim 24, wherein the stepping portions are hook-shaped and the stepping portions are separated from each other by a predetermined distance.

27. A finisher to post-process print media and connect to a multi-function peripheral comprising a printing portion and a discharge portion having an attaching direction, the finisher comprising:

a post processing portion which receives printed media from the printing media via the discharge portion and performs an additional process on the received media; and one or more fixing portions which detachably connect to the discharge portion and, when attached to the discharge portion, prevent the finisher from moving in the attaching direction, wherein the finisher further comprises a sensing portion that protrudes from the finisher to contact a sensor of multi-function peripheral when the finisher is installed on the discharge portion to operate the sensor.

28. A method to connect a finisher to a multi-function peripheral, the method comprising:

guiding one or more first fixing portions of the finisher along guide rails provided in the multi-function peripheral;

inserting the first fixing portions into one or more first recesses provided in the multi-function peripheral to prevent the finisher from moving in a first direction; and inserting one or more second fixing portions into one or more second recesses to prevent the finisher from moving in a second direction while allowing the finisher to be operable by the multi-function peripheral to perform post processes on printed media received from multi-function peripheral.

* * * * *

UNITED STATES PATENT AND TRADEMARK OFFICE

CERTIFICATE OF CORRECTION

PATENT NO. : 7,657,205 B2
APPLICATION NO. : 11/523700
DATED : February 2, 2010
INVENTOR(S) : Nae-wan Kang It is certified that error appears in the above-identified patent and that said Letters Patent is hereby corrected as shown below:

Column 6, Line 10, change "portion." to --portion,--.

Signed and Sealed this

Fifteenth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,657,205 B2
APPLICATION NO. : 11/523700
DATED : February 2, 2010
INVENTOR(S) : Nae-wan Kang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 674 days.

Signed and Sealed this

Twenty-eighth Day of December, 2010

David J. Kappos

David J. Kappos
*Director of the United States Patent and Trademark Office*